US012595944B2

(12) United States Patent
Reichwald et al.

(10) Patent No.: US 12,595,944 B2
(45) Date of Patent: Apr. 7, 2026

(54) METHOD FOR CONTROLLING A VAPOUR COMPRESSION SYSTEM WITH A RECEIVER COMPRESSOR

(71) Applicant: Danfoss A/S, Nordborg (DK)

(72) Inventors: Peter Reichwald, Nordborg (DK); Jan Prins, Nordborg (DK); Salvatore Piscopiello, Nordborg (DK)

(73) Assignee: DANFOSS A/S, Nordborg (DK)

( * ) Notice: Subject to any disclaimer, the term of this patent is extended or adjusted under 35 U.S.C. 154(b) by 395 days.

(21) Appl. No.: 18/550,799

(22) PCT Filed: Feb. 18, 2022

(86) PCT No.: PCT/EP2022/054095
§ 371 (c)(1),
(2) Date: Sep. 15, 2023

(87) PCT Pub. No.: WO2022/194489
PCT Pub. Date: Sep. 22, 2022

(65) Prior Publication Data

US 2024/0191921 A1 Jun. 13, 2024

(30) Foreign Application Priority Data

Mar. 18, 2021 (EP) ..... 21163499

(51) Int. Cl.
*F25B 41/39* (2021.01)

(52) U.S. Cl.
CPC ..... *F25B 41/39* (2021.01); *F25B 2400/0409* (2013.01); *F25B 2400/23* (2013.01);
(Continued)

(58) Field of Classification Search
CPC ..... F25B 41/39; F25B 2400/0409; F25B 2400/23; F25B 2500/19; F25B 2600/02; F25B 2400/06; F25B 2700/19
See application file for complete search history.

(56) References Cited

U.S. PATENT DOCUMENTS 9,395,112 B2 7/2016 Prins
10,544,971 B2 1/2020 Fredslund et al.
(Continued)

FOREIGN PATENT DOCUMENTS

EP 2 999 932 B1 7/2019
EP 3 581 860 A1 12/2019
(Continued)

OTHER PUBLICATIONS

International Search Report mailed on Apr. 7, 2022, in connection with corresponding International Application No. PCT/EP2022/054095; 3 pages.

*Primary Examiner* — Nelson J Nieves
(74) *Attorney, Agent, or Firm* — McCormick, Paulding & Huber PLLC

(57) ABSTRACT

A vapour compression system (1) including a compressor unit (2) having at least one main compressor (3) and at least one receiver compressor (4), a heat rejecting heat exchanger (5), a receiver (7), an expansion device (8) and an evaporator (9) being arranged in a refrigerant path. The vapour compression system (1) further includes a bypass valve (12) fluidly interconnecting the gaseous outlet (10) of the receiver (7) and the main compressor(s) (3). A pressure difference across the bypass valve (12) is measured or derived, and a mass flow rate of refrigerant through the bypass valve (12) is derived, based at least on the pressure difference across the bypass valve (12), and using a fluid model. A minimum mass flow rate of refrigerant required to operate the receiver compressor (4) is derived, based on a minimum displacement volume of the receiver compressor (4) and using a fluid model taking prevailing operating conditions into account. In the case that the derived mass flow rate of refrigerant through the bypass valve (12) exceeds the derived minimum mass flow rate of refrigerant
(Continued)

required to operate the receiver compressor (4), the receiver compressor (4) is started and the bypass valve (12) is closed.

19 Claims, 2 Drawing Sheets

(52) U.S. Cl.
CPC ..... *F25B 2500/19* (2013.01); *F25B 2600/02* (2013.01); *F25B 2600/2501* (2013.01)

(56) References Cited

U.S. PATENT DOCUMENTS

| | | | | |
|---|---|---|---|---|
| 10,775,086 | B2 | 9/2020 | Prins et al. | |
| 10,928,107 | B2 | 2/2021 | Schmidt et al. | |
| 10,941,964 | B2 | 3/2021 | Fredslund et al. | |
| 11,029,068 | B2 | 6/2021 | Christensen et al. | |
| 11,340,000 | B2 | 5/2022 | Schmidt et al. | |
| 11,460,230 | B2 | 10/2022 | Prins et al. | |
| 11,629,901 | B1 * | 4/2023 | Vaisman | F25B 43/00 62/115 |
| 2016/0102901 | A1 | 4/2016 | Christensen et al. | |
| 2018/0283750 | A1 * | 10/2018 | Prins | F25B 49/02 |
| 2019/0299132 | A1 * | 10/2019 | Prins | F25B 49/02 |
| 2019/0376728 | A1 | 12/2019 | Hayes et al. | |
| 2020/0124330 | A1 | 4/2020 | Hayes | |
| 2022/0034566 | A1 | 2/2022 | Prins et al. | |
| 2022/0196305 | A1 | 6/2022 | Prins et al. | |
| 2022/0221207 | A1 * | 7/2022 | Prins | F25B 1/10 |

FOREIGN PATENT DOCUMENTS

| | | | |
|---|---|---|---|
| EP | 3 628 940 | A1 | 4/2020 |
| WO | 2014/179442 | A1 | 11/2014 |
| WO | 2017/067858 | A1 | 4/2017 |

* cited by examiner

METHOD FOR CONTROLLING A VAPOUR COMPRESSION SYSTEM WITH A RECEIVER COMPRESSOR

CROSS-REFERENCE TO RELATED APPLICATIONS

This application is a National Stage application of International Patent Application No. PCT/EP2022/054095, filed on Feb. 18, 2022, which claims priority to European Patent Application No. 21163499.3, filed on Mar. 18, 2021, each of which is hereby incorporated by reference in its entirety.

TECHNICAL FIELD

The present invention relates to a method for controlling a vapour compression system with a receiver and a receiver compressor being fluidly connected directly to a gaseous outlet of the receiver. The method according to the invention efficiently ensures that the receiver compressor is stopped and started at optimal times, regardless of the prevailing operating conditions.

BACKGROUND

Vapour compression systems, such as refrigeration systems, air condition systems or heat pumps, normally comprise a compressor unit comprising one or more compressors, a heat rejecting heat exchanger, an expansion device and an evaporator arranged in a refrigerant path. Refrigerant flowing in the refrigerant path is thereby compressed by the compressor(s) of the compressor unit before being supplied to the heat rejecting heat exchanger. When passing through the heat rejecting heat exchanger, heat exchange takes place between the refrigerant and the ambient or a secondary fluid flowing across the heat rejecting heat exchanger, in such a manner that heat is rejected from the refrigerant. The refrigerant then passes through the expansion device, where it undergoes expansion, before being supplied to the evaporator. The refrigerant being supplied to the evaporator is in the form of a mixture of gaseous and liquid refrigerant. When passing through the evaporator, the liquid part of the refrigerant is evaporated, while heat exchange takes place between the refrigerant and the ambient or a secondary fluid flow across the evaporator, in such a manner that heat is absorbed by the refrigerant.

In some vapour compression systems a receiver is arranged in the refrigerant path between the heat rejecting heat exchanger and the expansion device. In the receiver, the refrigerant is separated into a gaseous part and a liquid part. The liquid part of the refrigerant is supplied to the expansion device, via a liquid outlet, in the manner described above. The gaseous part of the refrigerant may be supplied to the compressor unit, via a gaseous outlet. In this case the gaseous refrigerant may be supplied to the suction line which interconnects the outlet of the evaporator and the compressor unit, via a bypass valve. Alternatively, the gaseous refrigerant may be supplied directly to a dedicated receiver compressor, which does not receive refrigerant from the evaporator. Supplying the gaseous refrigerant to a receiver compressor is more energy efficient than supplying it to the suction line, via a bypass valve, or supplying it to the expansion device, because thereby a pressure drop is not introduced, and therefore the energy required in order to compress the refrigerant to a desired pressure level is lower.

It is therefore desirable to supply the gaseous refrigerant from the receiver to the receiver compressor whenever this is possible.

However, when the flow of gaseous refrigerant out of the receiver is low, it may be insufficient to maintain stable operation of the receiver compressor, thereby leading to repeated stops and starts of the receiver compressor and causing excessive wear on the receiver compressor. Under such circumstances it is more desirable to apply the bypass valve.

Thus, when the flow of gaseous refrigerant out of the receiver is low, and the receiver compressor is therefore stopped, a decision to start the receiver compressor should be made when it can be assumed that the flow of gaseous refrigerant out of the receiver has increased to a level which is sufficient to ensure stable operation of the receiver compressor. If the receiver compressor is started while the flow of gaseous refrigerant out of the receiver is still too low, this will result in undesired repeated starts and stops of the receiver compressor. On the other hand, if the receiver compressor remains stopped, even if the flow of gaseous refrigerant out of the receiver is in fact sufficient to ensure stable operation of the receiver compressor, then the vapour compression system is operated in a less energy efficient manner than possible.

The exact point in time where the flow of gaseous refrigerant out of the receiver is sufficient to ensure stable operation of the receiver compressor may be difficult to establish, and measurable parameter values which could indicate this depend on variable ambient operating conditions, such as ambient temperature, pressure conditions, etc.

Therefore, receiver compressors are often not started until it is beyond reasonable doubt that they can operate in a stable manner. Accordingly, there will be periods of time where the receiver compressor is stopped and the gaseous refrigerant from the receiver is supplied to the bypass valve, even though the receiver compressor could have been applied, and the vapour compression system could therefore have been operated in a more energy efficient manner.

EP 3 581 860 A1, corresponding to US 2019/0376728 A1, discloses a refrigeration system including a receiver, a gas bypass valve, a parallel compressor and a controller. The controller is configured to switch from operating the gas bypass valve to operating the parallel compressor to control the pressure of the gas refrigerant in the receiver in response to a value of a process variable crossing a switchover setpoint which depends on an amount of the gas refrigerant produced by the refrigeration system.

SUMMARY

It is an object of embodiments of the invention to provide a method for controlling a vapour compression system which allows a suitable switch point for starting or stopping a receiver compressor to be accurately determined, regardless of the prevailing operating conditions.

The invention provides a method for controlling a vapour compression system, the vapour compression system comprising a compressor unit comprising at least two compressors, a heat rejecting heat exchanger, a receiver, an expansion device and an evaporator being arranged in a refrigerant path, the expansion device being arranged to control a supply of refrigerant to the evaporator, at least one of the compressors being a main compressor being fluidly connected to an outlet of the evaporator and at least one of the compressors being a receiver compressor being fluidly connected to a gaseous outlet of the receiver, the vapour compression system further comprising a bypass valve fluidly interconnecting the gaseous outlet of the receiver and the main compressor(s), the method comprising the steps of:

measuring or deriving a pressure difference across the bypass valve, deriving a mass flow rate of refrigerant through the bypass valve, based at least on the pressure difference across the bypass valve, and using a fluid model, deriving a minimum mass flow rate of refrigerant required to operate the receiver compressor, based on a minimum displacement volume of the receiver compressor and using a fluid model taking prevailing operating conditions into account, comparing the derived mass flow rate of refrigerant through the bypass valve and the derived minimum mass flow rate of refrigerant required to operate the receiver compressor, and starting the receiver compressor and closing the bypass valve in the case that the derived mass flow rate of refrigerant through the bypass valve exceeds the derived minimum mass flow rate of refrigerant required to operate the receiver compressor.

Thus, the invention provides a method for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

Accordingly, the vapour compression system comprises a compressor unit, a heat rejecting heat exchanger, a receiver, an expansion device and an evaporator arranged in a refrigerant path. The expansion device is arranged to control a supply of refrigerant to the evaporator. The compressor unit comprises at least two compressors. At least one of the compressors is a main compressor being fluidly connected to an outlet of the evaporator, and at least one of the compressors is a receiver compressor being fluidly connected to a gaseous outlet of the receiver. The vapour compression system further comprises a bypass valve fluidly interconnecting the gaseous outlet of the receiver and the main compressor(s).

Thus, refrigerant flowing in the refrigerant path is compressed by the compressors of the compressor unit before being supplied to the heat rejecting heat exchanger. When the refrigerant passes through the heat rejecting heat exchanger, heat exchange takes place between the refrigerant and the ambient or a secondary fluid flow across the heat rejecting heat exchanger, in such a manner that heat is rejected from the refrigerant. The heat rejecting heat exchanger may be in the form of a condenser, in which case the refrigerant is at least partly condensed when passing through the heat rejecting heat exchanger. As an alternative, the heat rejecting heat exchanger may be in the form of a gas cooler, in which case the refrigerant passing through the heat rejecting heat exchanger is cooled, but remains in a gaseous or trans-critical state.

The refrigerant leaving the heat rejecting heat exchanger is supplied to the receiver, possibly via a high pressure valve or an ejector. In the receiver, the refrigerant is separated into a liquid part and a gaseous part. The liquid part of the refrigerant leaves the receiver via a liquid outlet, and is supplied to the evaporator, via the expansion device. In the expansion device, the refrigerant undergoes expansion, and the refrigerant supplied to the evaporator is in a mixed state of gaseous and liquid refrigerant. In the evaporator, the liquid part of the refrigerant is at least partly evaporated, while heat exchange takes place between the refrigerant and the ambient or a secondary fluid flow across the evaporator, in such a manner that heat is absorbed by the refrigerant. Finally, the refrigerant leaving the evaporator is supplied to the main compressor(s).

The gaseous part of the refrigerant in the receiver may leave the receiver via the gaseous outlet, and is either supplied directly to the receiver compressor(s) or to the main compressor(s), via the bypass valve.

In the method according to the invention, a pressure difference across the bypass valve is initially measured or derived. The pressure difference may be measured directly, e.g. by measuring the pressure prevailing in the receiver and the suction pressure, i.e. the pressure prevailing at the inlet of the main compressor(s). As an alternative, only the pressure prevailing in the receiver may be measured, and the pressure difference across the bypass valve may be derived based on the measured receiver pressure and a reference pressure value for the suction pressure. As another alternative, the pressure difference may be derived from reference pressure values for the pressure prevailing in the receiver and the suction pressure, respectively.

Next, a mass flow rate of refrigerant through the bypass valve is derived, based at least on the pressure difference across the bypass valve, and using a fluid model. The mass flow rate of refrigerant through the bypass valve is an accurate measure for the amount of gaseous refrigerant which needs to be removed from the receiver. The mass flow rate of refrigerant through the bypass valve is therefore an appropriate parameter for determining whether or not the amount of gaseous refrigerant leaving the receiver is sufficient to ensure stable operation of the receiver compressor.

It is an advantage that the mass flow rate of refrigerant through the bypass valve is derived using a fluid model, because thereby the behaviour of the refrigerant under the prevailing operating conditions, including the pressure difference across the bypass valve, are taken into account when deriving the mass flow rate. Thereby an accurate value of the mass flow rate of refrigerant through the bypass valve is obtained, regardless of the prevailing operating conditions.

In the present context the term 'fluid model' should be interpreted to mean a model which describes the behaviour of the refrigerant as a function of relevant operating conditions, such as ambient temperature, pressure conditions, etc. The fluid model may, e.g., specify various relevant properties of the refrigerant, such as density, pressure, temperature, etc., as a function of relevant ambient operating conditions.

Next, a minimum mass flow rate of refrigerant required in order to operate the receiver compressor is derived, based on a minimum displacement volume of the receiver compressor and using a fluid model taking prevailing operating conditions into account.

Compressors are normally designed with a certain minimum capacity, above which the compressor is able to operate in a stable manner. The minimum capacity is defined as a minimum displacement volume of gaseous medium, which is not sensitive to variations in ambient conditions. However, the mass flow being displaced by means of the compressor at a given volume displacement depends on a number of properties of the gaseous medium, e.g. the density of the gaseous medium. These properties may vary in response to variations in operating conditions, such as ambient temperature, pressure conditions, etc. Thereby the mass flow corresponding to a given volume displacement, such as the minimum displacement volume of the compressor, is also dependent on the prevailing operating conditions.

However, by using a fluid model which takes the prevailing operating conditions into account, a minimum mass flow rate of refrigerant corresponding to the minimum displacement volume of the receiver compressor, under the prevailing operating conditions, can be derived. Thereby the derived minimum mass flow rate indicates the lowest mass flow rate which ensures that the receiver compressor can operate in a stable manner.

Next, the derived mass flow rate of refrigerant through the bypass valve and the derived minimum mass flow rate of refrigerant required to operate the receiver compressor are compared. Since the derived mass flow rate through the bypass valve and the derived minimum mass flow rate of refrigerant required to operate the receiver compressor are both mass flow rates which take the prevailing operating conditions into account, they are directly comparable. Thus, the comparison can readily reveal whether or not the current mass flow rate through the bypass valve would be sufficient to ensure stable operation of the receiver compressor, if the refrigerant was supplied to the receiver compressor instead of to the bypass valve.

Finally, the receiver compressor is started and the bypass valve is closed in the case that the derived mass flow rate of refrigerant through the bypass valve exceeds the derived minimum mass flow rate of refrigerant required to operate the receiver compressor.

Thus, if it turns out that the mass flow of refrigerant which is currently passed through the bypass valve is in fact sufficient to ensure stable operation of the receiver compressor, then the gaseous refrigerant is supplied to the receiver compressor instead of to the bypass valve.

Since the decision of starting the receiver compressor and closing the bypass valve is made based on the comparison of derived mass flow values, as described above, an accurate basis for the decision is provided, which takes the prevailing operating conditions into account. Thereby it is ensured that the receiver compressor is applied as soon as this is appropriate, regardless of the prevailing operating conditions.

The method may further comprise the step of keeping the receiver compressor stopped and allowing the bypass valve to be open in the case that the derived mass flow rate of refrigerant through the bypass valve is lower than the derived minimum mass flow rate of refrigerant required to operate the receiver compressor.

According to this embodiment, in the case that the comparison reveals that the amount of gaseous refrigerant to be removed from the receiver is insufficient to ensure stable operation of the receiver compressor, then the receiver compressor is not started, and the bypass valve is allowed to stay open, i.e. the gaseous refrigerant from the receiver continues to be supplied to the bypass valve rather than to the receiver compressor. Thereby undesired repeated starts and stops of the receiver compressor are efficiently prevented.

The method may further comprise the step of controlling a pressure prevailing in the receiver by operating the receiver compressor in the case that the derived mass flow rate of refrigerant through the bypass valve exceeds the derived minimum mass flow rate of refrigerant required to operate the receiver compressor, and controlling the pressure prevailing in the receiver by operating an opening degree of the bypass valve in the case that the derived mass flow rate of refrigerant through the bypass valve is lower than the derived minimum mass flow rate of refrigerant required to operate the receiver compressor.

According to this embodiment, the pressure prevailing in the receiver is controlled, e.g. by means of a setpoint control strategy, either by appropriately operating the receiver compressor or by appropriately operating an opening degree of the bypass valve. When the mass flow rate of gaseous refrigerant out of the receiver is sufficient to ensure stable operation of the receiver compressor, then the pressure prevailing in the receiver is controlled by means of the receiver compressor, e.g. by controlling a capacity of the receiver compressor. On the other hand, when the mass flow rate of gaseous refrigerant out of the receiver is insufficient to ensure stable operation of the receiver compressor, then the pressure prevailing in the receiver is controlled by means of the bypass valve, e.g. by appropriately adjusting the opening degree of the bypass valve.

The step of deriving a mass flow rate of refrigerant through the bypass valve may further be based on an opening degree of the bypass valve.

According to this embodiment, the mass flow rate of refrigerant through the bypass valve is derived on the basis of the pressure difference across the bypass valve as well as on the opening degree of the bypass valve. The larger the opening degree of the bypass valve, the higher a mass flow rate can pass through the bypass valve. Therefore, the opening degree of the bypass valve is a relevant parameter when deriving the mass flow rate through the bypass valve.

The step of deriving a mass flow rate of refrigerant through the bypass valve may comprise modelling a density of the refrigerant under the prevailing operating conditions.

According to this embodiment, the fluid model applied when deriving the mass flow rate of refrigerant through the bypass valve includes a model of the density of the refrigerant as a function of relevant operating conditions, e.g. ambient temperature, pressure conditions, etc. The density of the refrigerant is relatively sensitive to ambient conditions, such as ambient temperature. Furthermore, the density of the refrigerant is relevant when deriving a mass flow rate from a volume flow rate, and an accurate estimate for the density of the refrigerant, under the given operating conditions, is therefore relevant when deriving the mass flow rate of refrigerant through the bypass valve.

The mass flow rate through the bypass valve could, e.g., be derived using an equation of the form:

$$\dot{m}=K_v \cdot OD_{Bypass} \cdot \sqrt{\rho \cdot \Delta P},$$

where $\dot{m}$ is the mass flow rate through the bypass valve, $K_v$ is a valve specific tuning parameter, $OD_{Bypass}$ is the opening degree of the bypass valve, $\rho$ is the density of the refrigerant, and $\Delta P$ is the pressure difference across the bypass valve. At least the density, $\rho$, may be modelled by means of a fluid model.

Similarly, the step of deriving a minimum mass flow rate of refrigerant required to operate the receiver compressor may comprise modelling a density of the refrigerant under the prevailing operating conditions. This is similar to the embodiment described above.

The minimum mass flow rate of refrigerant required to operate the receiver compressor could, e.g., be derived using an equation of the form:

$$\dot{m}=V_{min} \cdot \rho_{inlet} \cdot eff_{vol},$$

where $\dot{m}$ is the minimum mass flow rate of refrigerant required to operate the receiver compressor, $V_{min}$ is a compressor specific minimum displacement volume, $\beta_{inlet}$ is the density of the refrigerant at the inlet of the receiver compressor, and $eff_{vol}$ is a volumetric efficiency of the receiver compressor. At least the density, $\beta_{inlet}$, may be modelled by means of a fluid model.

The fluid model applied when deriving the mass flow rate of refrigerant through the bypass valve may be the same as the fluid model applied when deriving a minimum mass flow rate of refrigerant required to operate the receiver compressor.

The step of deriving a minimum mass flow rate of refrigerant required to operate the receiver compressor may comprise deriving a mass flow rate corresponding to a displacement volume of the receiver compressor which results in an expected duty cycle of the receiver compressor of between 50% and 150%, such as between 60% and 120%, such as approximately 80%.

In the present context the term 'duty cycle of the receiver compressor' should be interpreted to mean a fraction of the time during which the receiver compressor is running during operation.

Thus, according to this embodiment, it is assumed that the mass flow rate of refrigerant through the bypass valve is sufficient to ensure stable operation of the receiver compressor if it is expected to be sufficient to allow the receiver compressor to be running for at least 50% of the time. The expected duty cycle is a suitable measure for the expected starts and stops of the receiver compressor, and it is therefore appropriate to determine whether or not to start the receiver compressor based on this parameter.

It should be noted that, in the present context, a duty cycle of the receiver which is exactly 100% should be interpreted to mean that the duty cycle exactly matches a physical minimum which the compressor can achieve without stopping. Accordingly, a duty cycle which is above 100% should be interpreted to mean duty cycle which is correspondingly above this physical minimum. For instance, a duty cycle of 120% means that a drop in load on the compressor, which is lower than 20%, will not cause the compressor to stop.

The fluid model may define correlation between pressure, temperature and specific volume and/or density of the refrigerant. In particular, the fluid model may define such correlation at the dew line of the refrigerant. These parameters are relevant when translating a volume flow into a mass flow or vice versa. A fluid model which defines correlation between the parameters mentioned above is therefore suitable when deriving an accurate switch point for switching between operating the bypass valve and operating the receiver compressor.

The prevailing operating conditions may include ambient temperature. The ambient temperature has a significant impact on the refrigerant, in particular with respect to temperature, pressure and density of the refrigerant at various positions along the refrigerant path. It is therefore relevant to take the ambient temperature into account when deriving the minimum mass flow rate of refrigerant required to operate the receiver compressor.

For instance, the pressure required in the receiver in order to ensure appropriate operation of the vapour compression system is strongly connected to the ambient temperature. The pressure prevailing in the receiver furthermore affects the density of the refrigerant as well as the pressure difference across the bypass valve, and therefore the ambient temperature also affects these parameters in an indirect manner.

Furthermore, the ambient temperature affects the amount of vapour which enters the receiver, and thereby indirectly affects the mass flow rate from the gaseous outlet of the receiver.

Alternatively or additionally, the suction pressure, i.e. the pressure of refrigerant entering the main compressor(s), may be taken into account when deriving the mass flow rate through the bypass valve and/or when deriving the minimum mass flow rate of refrigerant required to operate the receiver compressor(s). For instance, the suction pressure may be applied as an input parameter value to the fluid model used for this purpose.

BRIEF DESCRIPTION OF THE DRAWINGS

The invention will now be described in further detail with reference to the accompanying drawings in which.

DETAILED DESCRIPTION

Figure 1:
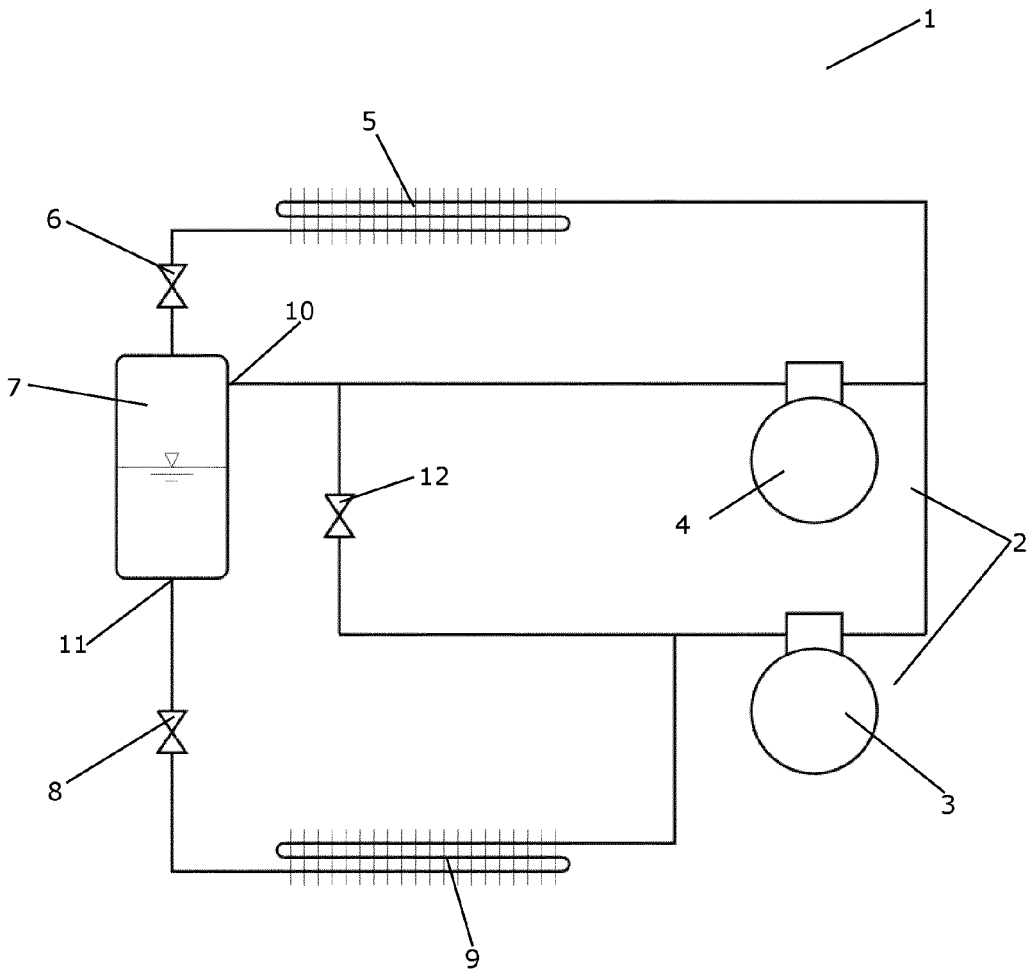
FIG. 1 is a diagrammatic view of a vapour compression system being controlled in accordance with a method according to an embodiment of the invention.

FIG. 1 is a diagrammatic view of a vapour compression system 1 being controlled in accordance with a method according to an embodiment of the invention. The vapour compression system 1 comprises a compressor unit 2 comprising at least two compressors 3, 4, two of which are shown, a heat rejecting heat exchanger 5, a high pressure valve 6, a receiver 7, an expansion valve 8 and an evaporator 9 arranged in a refrigerant path. Compressor 3 is a main compressor which is fluidly connected to an outlet of the evaporator 9, and compressor 4 is a receiver compressor which is fluidly connected to a gaseous outlet 10 of the receiver 7.

Refrigerant flowing in the refrigerant path is compressed by the compressors 3, 4 before being supplied to the heat rejecting heat exchanger 5. In the heat rejecting heat exchanger 5, heat exchange takes place between the refrigerant flowing through the heat rejecting heat exchanger 5 and the ambient or a secondary fluid flow across the heat rejecting heat exchanger 5, in such a manner that heat is rejected from the refrigerant.

The refrigerant leaving the heat rejecting heat exchanger 5 is passed through the high pressure valve 6, where it undergoes expansion before being supplied to the receiver 7. In the receiver 7, the refrigerant is separated into a liquid part and a gaseous part. The liquid part of the refrigerant leaves the receiver 7 via a liquid outlet 11, and is supplied to the expansion device 8, where it undergoes expansion before being supplied to the evaporator 9. The refrigerant being supplied to the evaporator 9 is thereby in a mixed gaseous and liquid state.

In the evaporator 9, heat exchange takes place between the refrigerant flowing through the evaporator 9 and the ambient or a secondary fluid flow across the evaporator 9, in such a manner that heat is absorbed by the refrigerant, while the liquid part of the refrigerant is at least partly evaporated. Finally, the refrigerant leaving the evaporator 9 is supplied to the main compressor 3.

The gaseous part of the refrigerant in the receiver 7 may leave the receiver via the gaseous outlet 10. The gaseous refrigerant may either be supplied directly to the receiver compressor 4, or it may be supplied to the main compressor 3, via a bypass valve 12. Thereby the pressure prevailing in the receiver 7 may be regulated either by appropriately controlling the capacity of the receiver compressor 4 or by appropriately controlling an opening degree of the bypass valve 12.

When the vapour compression system 1 of FIG. 1 is controlled in accordance with a method according to an embodiment of the invention, it is ensured that the receiver compressor 4 is only operated when the available amount of gaseous refrigerant in the receiver 7 is sufficient to ensure stable operation of the receiver compressor 4. Furthermore, the decision to switch between operating the bypass valve 12 and operating the receiver compressor 4 is based on an accurate foundation, taking the prevailing operating conditions into account. Thereby it is ensured that the receiver compressor 4 is applied whenever this is appropriate. This may, e.g., be obtained in the manner described below with reference to FIG. 2.

Figure 2:
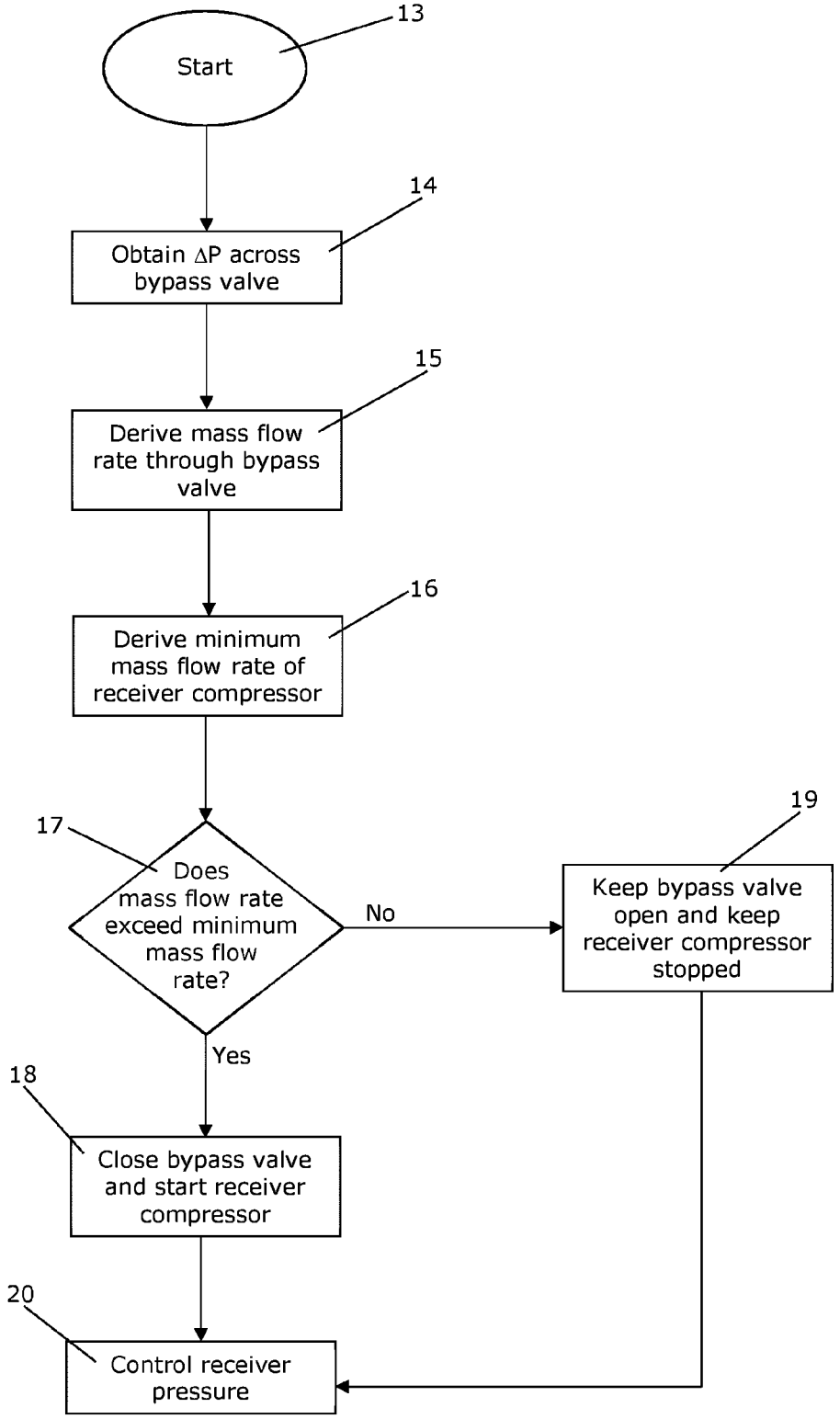
FIG. 2 is a flow chart illustrating a method according to an embodiment of the invention.

FIG. 2 is a flow chart illustrating a method according to an embodiment of the invention. The process is started at step 13. At step 14 a pressure difference, ΔP, across the bypass valve is obtained, e.g. by direct measurement or by deriving the pressure difference from one or more other measured parameters.

At step 15 a mass flow rate of refrigerant through the bypass valve is derived. The mass flow rate is derived based on the obtained pressure difference across the bypass valve, and possibly on further relevant parameters, such as an opening degree of the bypass valve. Furthermore, the mass flow rate is derived using a fluid model, and thereby expected behaviour of the refrigerant, under the given operating conditions, is taken into account. The derived mass flow rate of refrigerant through the bypass valve is thereby very accurate, and provides an accurate measure for the available amount of gaseous refrigerant.

At step 16 a minimum mass flow rate of refrigerant required to operate the receiver compressor is derived. The minimum mass flow rate is derived based on a minimum displacement volume of the receiver compressor, i.e. on the minimum volume which the receiver compressor must displace in order to operate in a stable manner and without too many starts and stops. Furthermore, the minimum mass flow rate is derived using a fluid model which takes the prevailing operating conditions into account. Thereby the derived minimum mass flow rate provides a very accurate measure for the mass flow rate which needs to be available in order to ensure stable operation of the receiver compressor, under the prevailing operating conditions.

At step 17 the derived mass flow rate of refrigerant through the bypass valve and the derived minimum mass flow rate of refrigerant required to operate the receiver compressor are compared in order to determine whether or not the currently available amount of gaseous refrigerant is sufficient to ensure stable operation of the receiver compressor.

Thus, in the case that step 17 reveals that the derived mass flow rate of refrigerant through the bypass valve exceeds the derived minimum mass flow rate of refrigerant required to operate the receiver compressor, it can be concluded that the available amount of gaseous refrigerant is sufficient to ensure stable operation of the receiver compressor. Therefore, when this is the case, the process is forwarded to step 18, where the bypass valve is closed and the receiver compressor is started. Thereby, the refrigerant leaving the receiver is supplied to the receiver compressor, rather than to the bypass valve, and the vapour compression system is operated in an energy efficient manner.

In the case that the comparison of step 17 reveals that the derived mass flow rate of refrigerant through the bypass valve does not exceed the derived minimum mass flow rate of refrigerant required to operate the receiver compressor, it can be concluded that the available amount of gaseous refrigerant is not sufficient to ensure stable operation of the receiver compressor. Therefore, when this is the case, the process is forwarded to step 19, where the bypass valve is kept open and the receiver compressor is kept in a stopped state. Thereby, the refrigerant leaving the receiver is supplied to the bypass valve, rather than to the receiver compressor, and repeated stops and starts of the receiver compressor, due to the insufficient amount of available gaseous refrigerant, are prevented.

Finally, at step 20, the pressure prevailing in the receiver is controlled by appropriately controlling the capacity of the receiver compressor, or by appropriately controlling the opening degree of the bypass valve, depending on the outcome of the comparison of step 17.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system, the vapour compression system comprising a compressor unit comprising at least two compressors, a heat rejecting heat exchanger, a receiver, an expansion device and an evaporator being arranged in a refrigerant path, the expansion device being arranged to control a supply of refrigerant to the evaporator, at least one of the compressors being a main compressor being fluidly connected to an outlet of the evaporator and at least one of the compressors being a receiver compressor being fluidly connected to a gaseous outlet of the receiver, the vapour compression system further comprising a bypass valve fluidly interconnecting the gaseous outlet of the receiver and the main compressor(s), the method comprising the steps of:

measuring or deriving a pressure difference across the bypass valve, deriving a mass flow rate of refrigerant through the bypass valve, based at least on the pressure difference across the bypass valve, and using a fluid model, deriving a minimum mass flow rate of refrigerant required to operate the receiver compressor, based on a minimum displacement volume of the receiver compressor and using a fluid model taking prevailing operating conditions into account, comparing the derived mass flow rate of refrigerant through the bypass valve and the derived minimum mass flow rate of refrigerant required to operate the receiver compressor, and starting the receiver compressor and closing the bypass valve in the case that the derived mass flow rate of refrigerant through the bypass valve exceeds the derived minimum mass flow rate of refrigerant required to operate the receiver compressor.

2. The method according to claim 1, further comprising the step of keeping the receiver compressor stopped and allowing the bypass valve to be open in the case that the derived mass flow rate of refrigerant through the bypass valve is lower than the derived minimum mass flow rate of refrigerant required to operate the receiver compressor.

3. The method according to claim 1, further comprising the step of controlling a pressure prevailing in the receiver by operating the receiver compressor in the case that the derived mass flow rate of refrigerant through the bypass valve exceeds the derived minimum mass flow rate of refrigerant required to operate the receiver compressor, and controlling the pressure prevailing in the receiver by operating an opening degree of the bypass valve in the case that the derived mass flow rate of refrigerant through the bypass valve is lower than the derived minimum mass flow rate of refrigerant required to operate the receiver compressor.

4. The method according to claim 1, wherein the step of deriving a mass flow rate of refrigerant through the bypass valve is further based on an opening degree of the bypass valve.

5. The method according to claim 1, wherein the step of deriving a mass flow rate of refrigerant through the bypass valve comprises modelling a density of the refrigerant under the prevailing operating conditions.

6. The method according to claim 1, wherein the step of deriving a minimum mass flow rate of refrigerant required to operate the receiver compressor comprises modelling a density of the refrigerant under the prevailing operating conditions.

7. The method according to claim 1, wherein the step of deriving a minimum mass flow rate of refrigerant required to operate the receiver compressor comprises deriving a mass flow rate corresponding to a displacement volume of the receiver compressor which results in an expected duty cycle of the receiver compressor of between 50% and 150%.

8. The method according to claim 1, wherein the fluid model defines correlation between pressure, temperature and specific volume and/or density of the refrigerant.

9. The method according to claim 1, wherein the prevailing operating conditions include ambient temperature.

10. The method according to claim 2, further comprising the step of controlling a pressure prevailing in the receiver by operating the receiver compressor in the case that the derived mass flow rate of refrigerant through the bypass valve exceeds the derived minimum mass flow rate of refrigerant required to operate the receiver compressor, and controlling the pressure prevailing in the receiver by operating an opening degree of the bypass valve in the case that the derived mass flow rate of refrigerant through the bypass valve is lower than the derived minimum mass flow rate of refrigerant required to operate the receiver compressor.

11. The method according to claim 2, wherein the step of deriving a mass flow rate of refrigerant through the bypass valve is further based on an opening degree of the bypass valve.

12. The method according to claim 3, wherein the step of deriving a mass flow rate of refrigerant through the bypass valve is further based on an opening degree of the bypass valve.

13. The method according to claim 2, wherein the step of deriving a mass flow rate of refrigerant through the bypass valve comprises modelling a density of the refrigerant under the prevailing operating conditions.

14. The method according to claim 3, wherein the step of deriving a mass flow rate of refrigerant through the bypass valve comprises modelling a density of the refrigerant under the prevailing operating conditions.

15. The method according to claim 4, wherein the step of deriving a mass flow rate of refrigerant through the bypass valve comprises modelling a density of the refrigerant under the prevailing operating conditions.

16. The method according to claim 2, wherein the step of deriving a minimum mass flow rate of refrigerant required to operate the receiver compressor comprises modelling a density of the refrigerant under the prevailing operating conditions.

17. The method according to claim 3, wherein the step of deriving a minimum mass flow rate of refrigerant required to operate the receiver compressor comprises modelling a density of the refrigerant under the prevailing operating conditions.

18. The method according to claim 4, wherein the step of deriving a minimum mass flow rate of refrigerant required to operate the receiver compressor comprises modelling a density of the refrigerant under the prevailing operating conditions.

19. The method according to claim 5, wherein the step of deriving a minimum mass flow rate of refrigerant required to operate the receiver compressor comprises modelling a density of the refrigerant under the prevailing operating conditions.

* * * * *